United States Patent [19]

Andersson

[11] 4,003,418

[45] Jan. 18, 1977

[54] COMBINATION TOOL

[76] Inventor: Allan Andersson, Kjellbergsgatan 6, 41132 Goteborg, Sweden

[22] Filed: Sept. 12, 1975

[21] Appl. No.: 612,722

[30] Foreign Application Priority Data

Sept. 16, 1974 Sweden ..... 7411615

[52] U.S. Cl. ..... 145/50 C; 7/17; 145/61 R; D8/85

[51] Int. Cl.[2] ..... B25B 15/02

[58] Field of Search ..... 7/15, 1 F, 17; 145/50 C, 61 R; D8/85, 83, 82

[56] References Cited

UNITED STATES PATENTS

| | | | |
|---|---|---|---|
| 317,007 | 4/1885 | Payson | 145/50 C |
| 3,742,787 | 7/1973 | Whiteford | D8/82 |
| D180,643 | 7/1957 | Fitch | 145/50 C |

*Primary Examiner*—Al Lawrence Smith
*Assistant Examiner*—Roscoe V. Parker

[57] ABSTRACT

A combination tool comprising a ball-shaped handle member and at least three substantially straight work-engaging members projecting substantially radially from said ball-shaped handle member, the tips of said work-engaging members defining a plane spaced from the surface of said handle member. At least three orientation rings are provided, each extending along the intersection of the surface of the handle member with a plane extending through the handle member center at right angles to one of the work-engaging members.

2 Claims, 2 Drawing Figures

COMBINATION TOOL

The present invention relates to a combination tool comprising a handle part and a number of engaging parts.

It is an object of the present invention to provide a combination tool, which is easy to carry with one and to store and which offers a good grip for the hand and consequently a good transmission of power from the hand in relation to its size.

Said objects are reached by the combination tool according to the present invention, which substantially is characterized by the handle part comprising a ball-like body and by the engaging parts being mounted on the mantle surface of the handle part.

Figure 1:
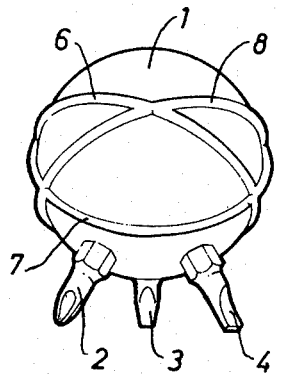
Figure 2:
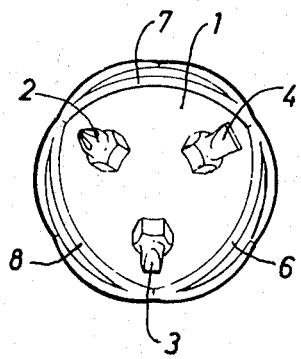

The invention will now be described more in detail by means of an example of embodiment, reference being made to the accompanying drawing, in which the FIGS. 1 and 2 illustrate two different views of the combination tool.

As is evident from the embodiment shown in the FIGS. 1 and 2, the combination tool according to the invention substantially comprises a handle part 1 of ball-like shape and engaging parts 2, 3, 4, which in the example shown include three different screw drivers. In the example shown the handle part 1 exhibits a completely spherical shape, the engaging parts 2, 3, 4 being mounted in fixed position in the mantle surface 5 of the sphere and substantially pointing outwards in radial direction from said surface. As is shown, they can advantageously be given such a position that they from a tripod, by means of which the combination tool can be placed in a stable and decorative manner for example on a writing desk.

According to the invention the handle part 1 in its mantle surface is provided with peripherically extending orientation rings 6, 7, 8, which in the example shown include three units, one ring for each engaging part 2, 3, 4 respectively. The orientation rings are advantageously located in such a manner that they coincide each one with its diametrical plane through the handle part 1 and in addition occupy a symmetric position relative to each one of the engaging parts 2, 3, 4 respectively in such a way that the longitudinal direction of said engaging parts cuts the corresponding diametrical plane of each orientation ring at a right angle. In this manner a good centering of each individual engaging part 2, 3, 4 respectively is obtained as well as a good transmission of power from the hand by means of the increase of radius brought about by the orientation rings 6, 7, and 8 respectively. Moreover the engaging parts 2, 3, and 4 respectively to advantage can be given such a length that one can grip around the handle part 1 with the hand without the fingers constituting any obstacle for the work.

The invention is not limited to the example of embodiment described above and illustrated in the drawings, but can be varied within the scope of the following claims. By way of example the orientation rings can exhibit a different extension than the one shown and in addition be provided with friction increasing grooves.

Also the orientation rings can be substituted by peripherically extending grooves.

I claim:

1. A combination tool comprising a ball-shaped handle member and at least three substantially straight work-engaging members projecting substantially radially from said ball-shaped handle member, the tips of said work-engaging members defining a plane spaced from the surface of said handle member.

2. A combination tool as claimed in claim 1, in which the handle member is provided with a number of orientation rings equal to the number of said work-engaging members, each of said rings extending along the intersection of the surface of the handle member with a plane extending through the handle member center at right angles to one of the work-engaging members.

* * * * *